US010177450B2

(12) United States Patent
Lin et al.

(10) Patent No.: US 10,177,450 B2
(45) Date of Patent: Jan. 8, 2019

(54) ELECTRONIC DEVICE

(71) Applicant: Chiun Mai Communication Systems, Inc., New Taipei (TW)

(72) Inventors: Yen-Hui Lin, New Taipei (TW); Chien-Chang Liu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 218 days.

(21) Appl. No.: 15/197,768

(22) Filed: Jun. 30, 2016

(65) Prior Publication Data

US 2017/0141462 A1 May 18, 2017

(30) Foreign Application Priority Data

Nov. 13, 2015 (CN) ..... 2015 1 0774610

(51) Int. Cl.

| | |
|---|---|
| ***H01Q 1/50*** | (2006.01) |
| ***H01Q 1/27*** | (2006.01) |
| ***H01Q 7/00*** | (2006.01) |
| ***H01Q 9/30*** | (2006.01) |
| ***H01Q 1/48*** | (2006.01) |
| ***H01Q 5/328*** | (2015.01) |

(52) U.S. Cl.

CPC ..... *H01Q 1/50* (2013.01); *H01Q 1/273* (2013.01); *H01Q 1/48* (2013.01); *H01Q 5/328* (2015.01); *H01Q 7/00* (2013.01); *H01Q 9/30* (2013.01)

(58) Field of Classification Search

CPC .. H01Q 1/50; H01Q 1/48; H01Q 7/00; H01Q 9/30

USPC ..... 343/853

See application file for complete search history.

(56) References Cited

U.S. PATENT DOCUMENTS

| | | | | |
|---|---|---|---|---|
| 7,215,600 | B1 | 5/2007 | DeRosa | |
| 2013/0335280 | A1* | 12/2013 | Chen, III ..... | H01Q 21/28 343/725 |
| 2014/0225786 | A1* | 8/2014 | Lyons ..... | H01Q 1/273 343/702 |

FOREIGN PATENT DOCUMENTS

| | | | |
|---|---|---|---|
| CN | 104638361 | A | 5/2015 |

* cited by examiner

*Primary Examiner* — Andrea Lindgren Baltzell
(74) *Attorney, Agent, or Firm* — ScienBiziP, P.C.

(57) ABSTRACT

An electronic device includes a frame, a baseboard, and at least one ground portion. The frame is formed of at least one conductive material. The baseboard is received in the frame and is spaced from the frame. The baseboard and the frame cooperatively form a gap. The baseboard includes a feed point electrically connected to the frame. One end of each ground portion is electrically connected to the frame and another end of each ground portion is grounded through a high pass filter (HPF).

11 Claims, 25 Drawing Sheets

ELECTRONIC DEVICE

CROSS-REFERENCE TO RELATED APPLICATIONS

This application claims priority to Chinese Patent Application No. 201510774610.1 filed on Nov. 13, 2015, the contents of which are incorporated by reference herein.

FIELD

The subject matter herein generally relates to an electronic device employing a metal housing.

BACKGROUND

Wearable devices, such as smart watches, bracelets, generally have a wireless communication function and include an antenna for establishing a wireless communication connection with other electronic devices, such as mobile phones, or personal digital assistants, for example. Additionally, many wearable devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
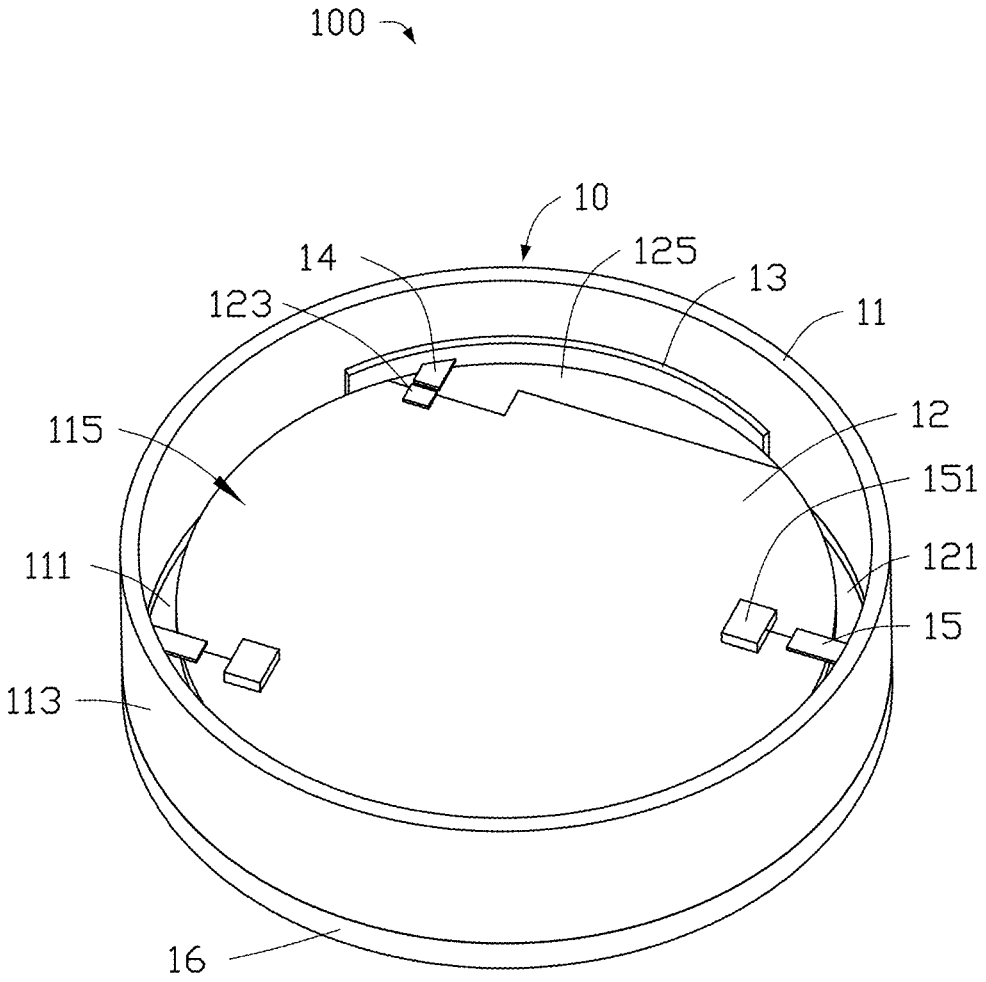
FIG. 1 is an elevational view of a first embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an electronic device.

FIG. 1 illustrates a first embodiment of an electronic device 100, which can be a wearable device, for example, a bracelet, a smart watch, a pair of glasses, and/or a helmet. The electronic device 100 can also be an electronic product, for example, a mobile phone or a personal digital assistant. In at least one embodiment, the electronic device 100 is a smart watch.

The electronic device 100 includes a main body 10. The main body 10 can be attached to a wrist of a user through a connecting portion, for example, a wristband. The main body 10 includes a frame 11, a baseboard 12, a radiating portion 13, a first feed portion 14, at least one ground portion 15, and a housing 16.

In at least one embodiment, the frame 11 is substantially circular. The frame 11 is made of conductive material, for example, metallic material. It can be understood that a shape of the frame 11 is not limited to be circular, it can have other shapes, for example, rectangular or oval. The frame 11 includes a bottom wall 111 and a peripheral wall 113. The peripheral wall 113 is positioned at a periphery of the bottom wall 111. The bottom wall 111 and the peripheral wall 113 cooperatively form a receiving space 115 with one end opened.

In at least one embodiment, the baseboard 12 is a printed circuit board (PCB). The baseboard 12 is positioned in the receiving space 115 and is spaced from the frame 11. That is, a periphery of the baseboard 12 is spaced from the peripheral wall 113 of the frame 11, therefore defining a gap 121 therebetween. In at least one embodiment, the gap 121 is substantially a loop and has a width of about 2 mm.

The baseboard 12 includes a feed point 123 and a keep-out-zone 125. The feed point 123 is electrically connected to a signal source, for example, a radio frequency (RF) transceiving unit (not shown) for feeding current to the radiating portion 13. The purpose of the keep-out-zone 125 is to delineate an area on the baseboard 12 in which other electronic elements (such as a camera, a vibrator, a speaker, etc.) cannot be placed. A shape of the keep-out-zone 125 and a position of the keep-out-zone 125 on the baseboard 12 can be adjusted according to a need of the user.

In at least one embodiment, the radiating portion 13 is a monopole antenna. The radiating portion 13 is positioned in the gap 121. The radiating portion 13 is spaced from the baseboard 12. The radiating portion 13 is also spaced from the frame 11 and is coupled to the frame 11 through a capacitor (not shown).

The first feed portion 14 is made of conductive material. One end of the first feed portion 14 is electrically connected to the radiating portion 13. Another end of the first feed portion 14 is electrically connected to the feed point 123 and is configured to feed current to the radiating portion 13.

Figure 2:
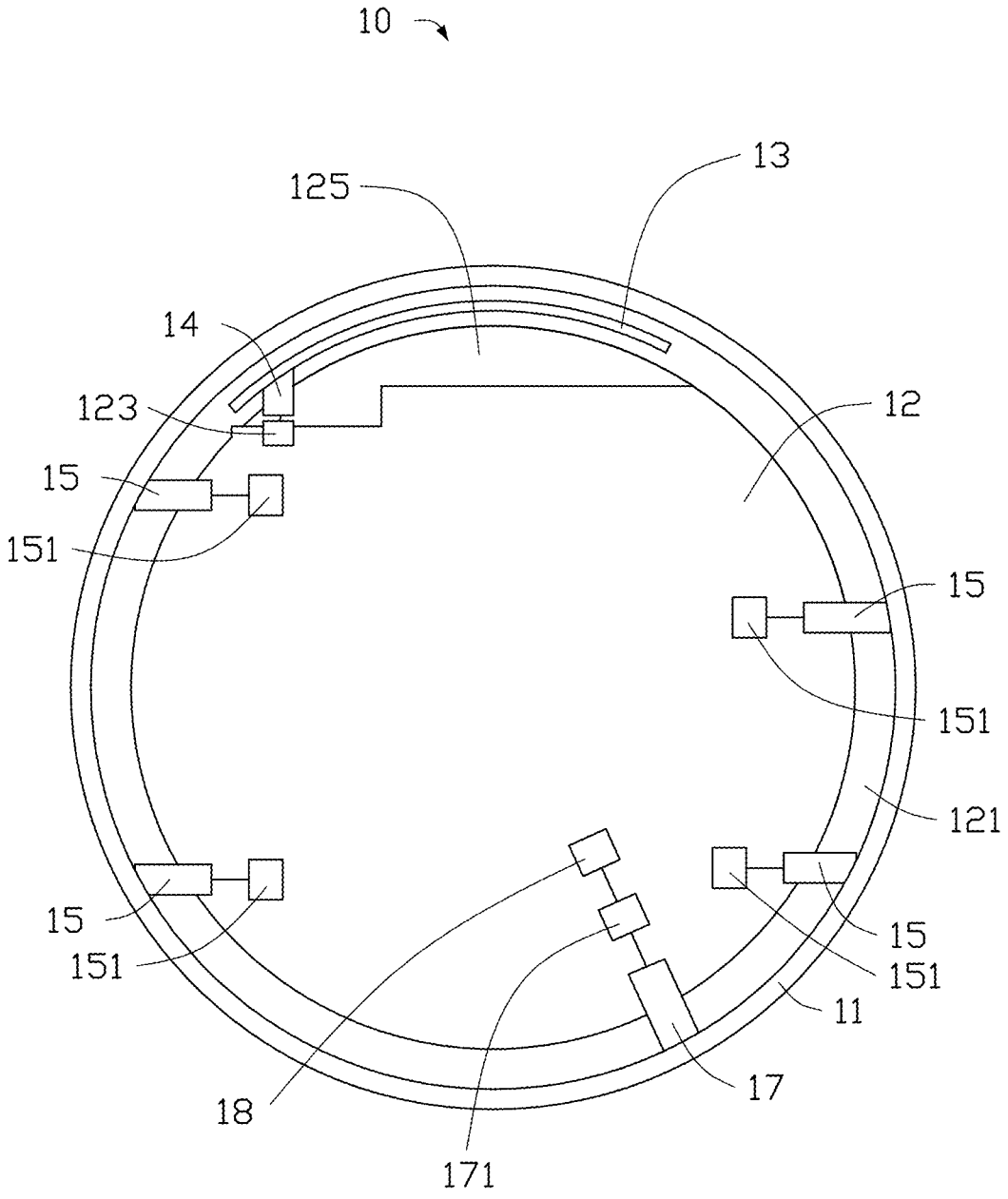
FIG. 2 is similar to FIG. 1, but shown in another angle.

As illustrated in FIG. 2, in at least one embodiment, the main body 10 includes four ground portions 15. The fourth ground portions 15 are spaced from each other. Each grounding portion 15 is made of conductive material. One end of each ground portion 15 is electrically connected to the frame 11. Another end of each ground portion 15 is grounded through a high pass filter (HPF) 151. Then when the electronic device 100 is operated, current enters the first feed portion 14 through the feed point 123 and flows to the radiating portion 13. The current is further coupled to the frame 11 through the radiating portion 13 and is grounded through the HPFs 151. By adjusting a length of the gap 121, the electronic device 100 can work at a first working frequency band, for example, BT/WIFI/GPS band. Additionally, because the ground portions 15 are grounded through the HPFs 151 when the electronic device 100 works at the first working frequency band, a signal from a second working frequency band, for example, an electrocardiography (ECG) signal or a Near Field Communication (NFC) signal can be effectively insulated.

The housing 16 is a portion of the electronic device 100 contacting a user. The housing 16 has a shape and a structure corresponding to the frame 11. For example, the housing 16 can be circular or square-shaped. The housing 16 is assembled to the frame 11 through a latching structure, for example, screw. The housing 16 seals the receiving space 115 through assembling to the bottom wall 111 of the frame 11 and receives the baseboard 12 and the ground portion 15 together with the frame 11. The housing 16 can be made of conductive material (for example, a metallic material), insulating material (for example, plastic or ceramic), or a combination of the conductive material and the insulating material.

As illustrated in FIGS. 1 and 2, in the exemplary embodiment, the electronic device 100 further has an ECG function. The electronic device 100 includes a second feed portion 17 and a physiology sensing unit 18. The physiology sensing unit 18 and the RF transceiving unit cooperatively share the frame 11. Then, the electronic device 100 can work at the first working frequency band and the second working frequency band.

In detail, the second feed portion 17 and the housing 16 are both made of conductive materials. The housing 16 is electrically connected to the physiology sensing unit 18. One end of the second feed portion 17 is electrically connected to the frame 11. Another end of the second feed portion 17 is electrically connected to the physiology sensing unit 18 through a low pass filter (LPF) 171. Then, the frame 11 and the housing 16 can be served as two electrodes for detecting a physiology signal. In detail, the frame 11 can be served as a positive electrode and the housing 16 can be served as a negative electrode. The physiology sensing unit 18 detects the physiology signal through the frame 11 and the housing 16. For example when the electronic device 100 is attached to the wrist of the user, the housing 16 contacts the skin of the user. When the other hand of the user contacts the frame 11, the physiology sensing unit 18 detects the physiology signal, for example an ECG signal, through the frame 11 and the housing 16, a physiological status of the user, such as heartbeat of the user, can be detected.

In at least one embodiment, when the electronic device 100 works at the first working frequency band, due to each ground portion 15 of the electronic device 100 being grounded through one HPF 151, a signal from the second working frequency band, that is of the ECG band, can be effectively insulated. When the electronic device 100 works at the second working frequency band, due to the second feed portion 17 being electrically connected to the physiology sensing unit 18 through the LPF 171, the signal from the second feed portion 17 can be effectively insulated. That is, the first working frequency band can also be effectively insulated.

Figure 3:
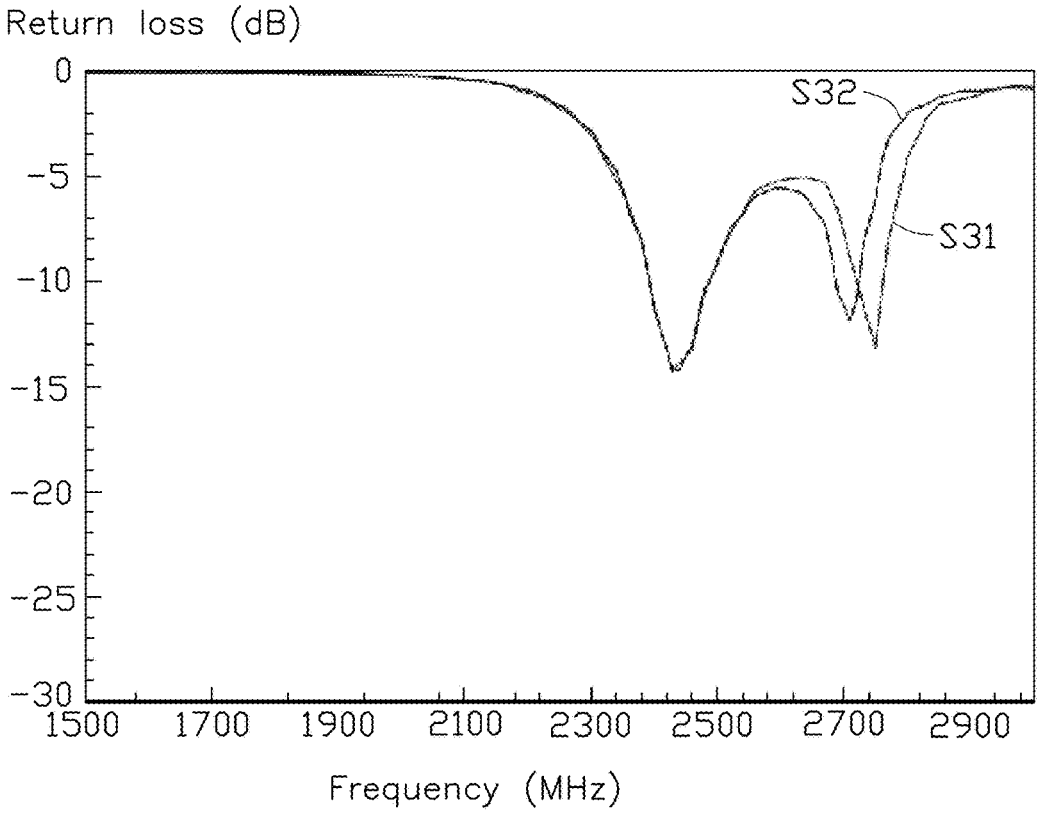
FIG. 3 is a return loss graph of the electronic device of FIG. 1.

FIG. 3 illustrates a return loss graph of the electronic device 100. Curve S31 illustrates a return loss of the electronic device 100 when each ground portion 15 is in series with a resistor having a resistance of about 0 ohm. Curve S32 illustrates a return loss of the electronic device 100 when each ground portion 15 is in series with a capacitor having a capacitance of about 20 pF.

Figure 4:
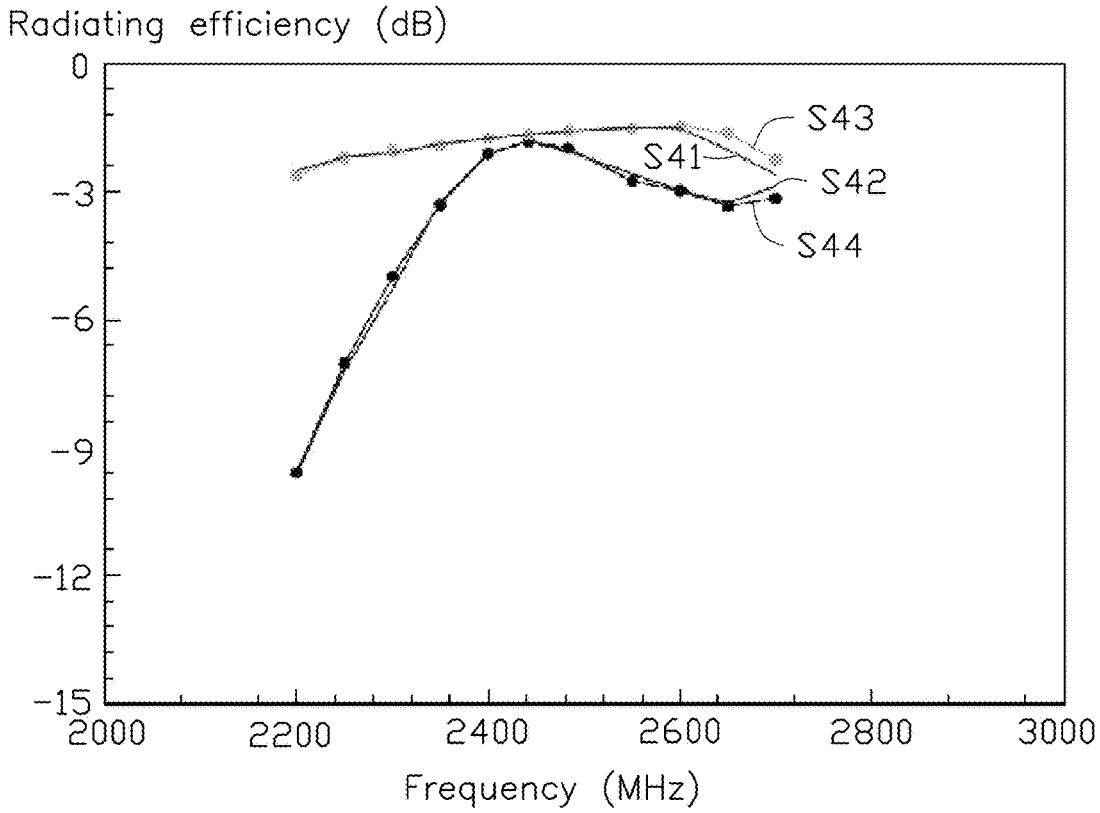
FIG. 4 is a radiating efficiency graph of the electronic device of FIG. 1.

FIG. 4 illustrates a radiating efficiency graph of the electronic device 100. Curve S41 illustrates a radiating efficiency of the electronic device 100 when each ground portion 15 is in series with a resistor having a resistance of about 0 ohm. Curve S42 illustrates a total radiating efficiency of the electronic device 100 when each ground portion 15 is in series with a resistor having a resistance of about 0 ohm. Curve S43 illustrates a radiating efficiency of the electronic device 100 when each ground portion 15 is in series with a capacitor having a capacitance of about 20 pF. Curve S44 illustrates a total radiating efficiency of the electronic device 100 when each ground portion 15 is in series with a capacitor having a capacitance of about 20 pF.

Figure 5:
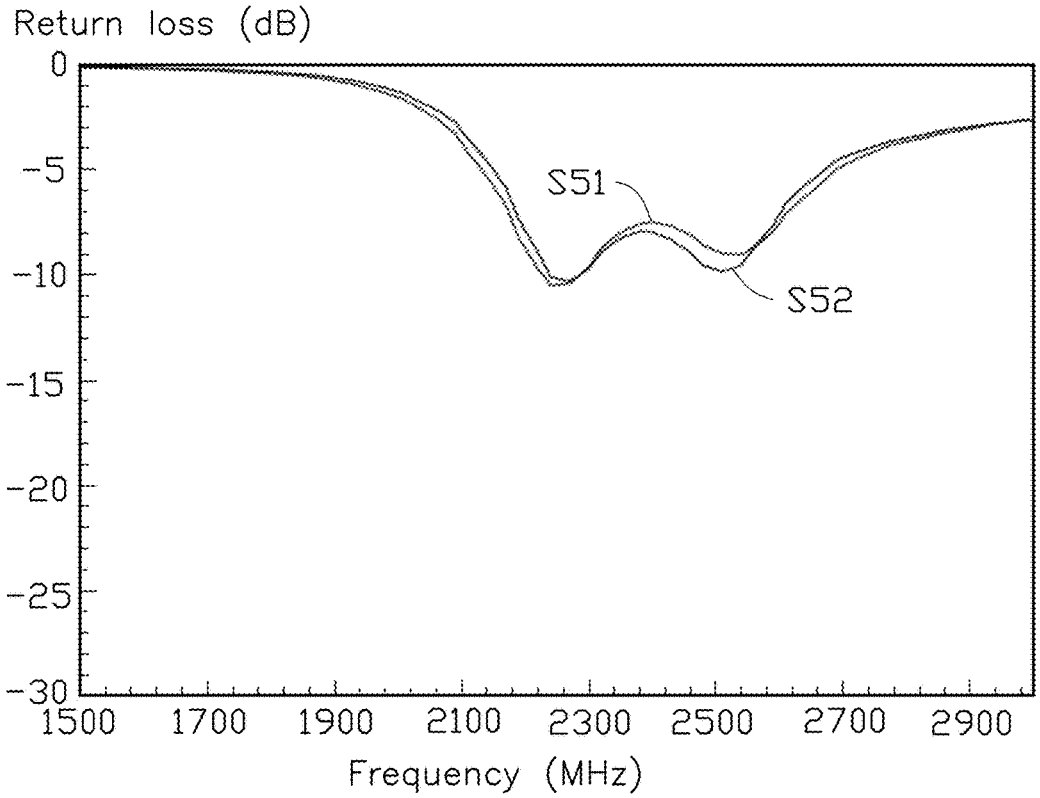
FIG. 5 is a return loss graph of the electronic device of FIG. 1 when the electronic device is attached to a wrist of a user.

FIG. 5 illustrates a return loss graph of the electronic device 100 when the electronic device 100 is attached to the wrist of the user. Curve S51 illustrates a return loss of the electronic device 100 when the electronic device 100 is attached to the wrist of the user and each ground portion 15 is in series with a resistor having a resistance of about 0 ohm. Curve S52 illustrates a return loss of the electronic device 100 when the electronic device 100 is attached to the wrist of the user and each ground portion 15 is in series with a capacitor having a capacitance of about 20 pF.

Figure 6:
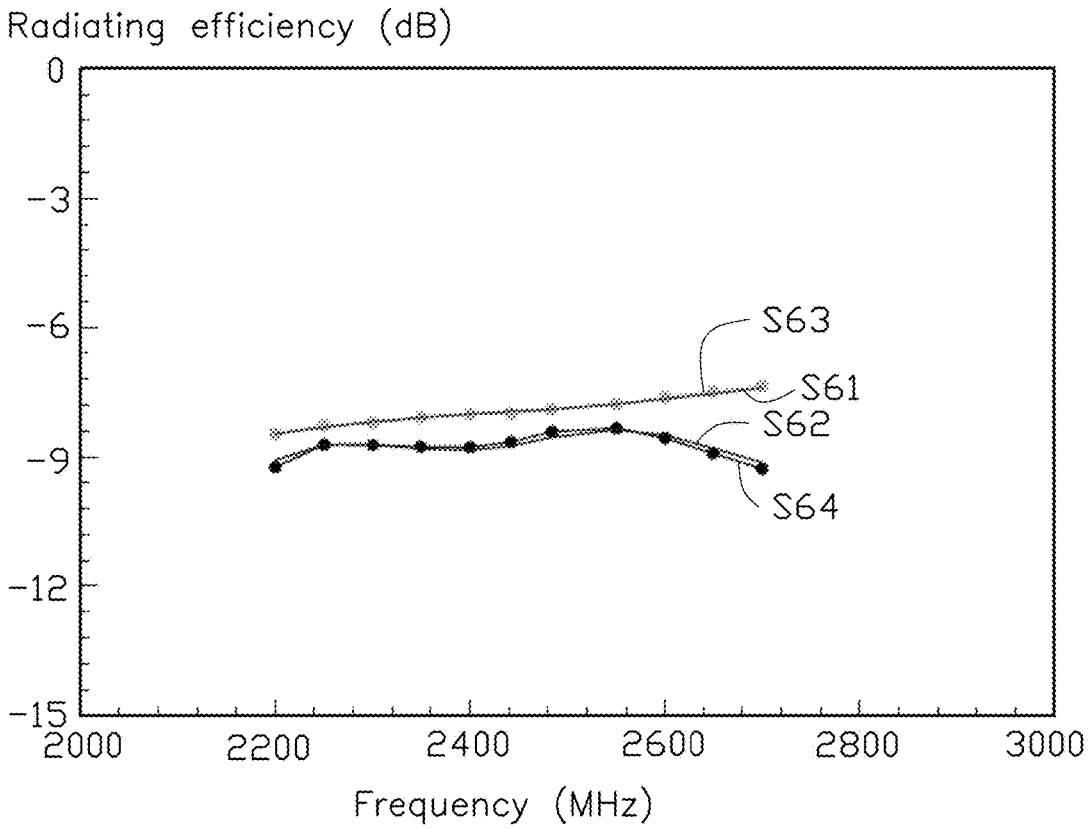
FIG. 6 is a radiating efficiency graph of the electronic device of FIG. 1 when the electronic device is attached to a wrist of a user.

FIG. 6 illustrates a radiating efficiency graph of the electronic device 100 when the electronic device 100 is attached to the wrist of the user. Curve S61 illustrates a radiating efficiency of the electronic device 100 when the electronic device 100 is attached to the wrist of the user and each ground portion 15 is in series with a resistor having a resistance of about 0 ohm. Curve S62 illustrates a total radiating efficiency of the electronic device 100 when the electronic device 100 is attached to the wrist of the user and each ground portion 15 is in series with a resistor having a resistance of about 0 ohm. Curve S63 illustrates a radiating efficiency of the electronic device 100 when the electronic device 100 is attached to the wrist of the user and each ground portion 15 is in series with a capacitor having a capacitance of about 20 pF. Curve S64 illustrates a total radiating efficiency of the electronic device 100 when the electronic device 100 is attached to the wrist of the user and each ground portion 15 is in series with a capacitor having a capacitance of about 20 pF.

Figure 7:
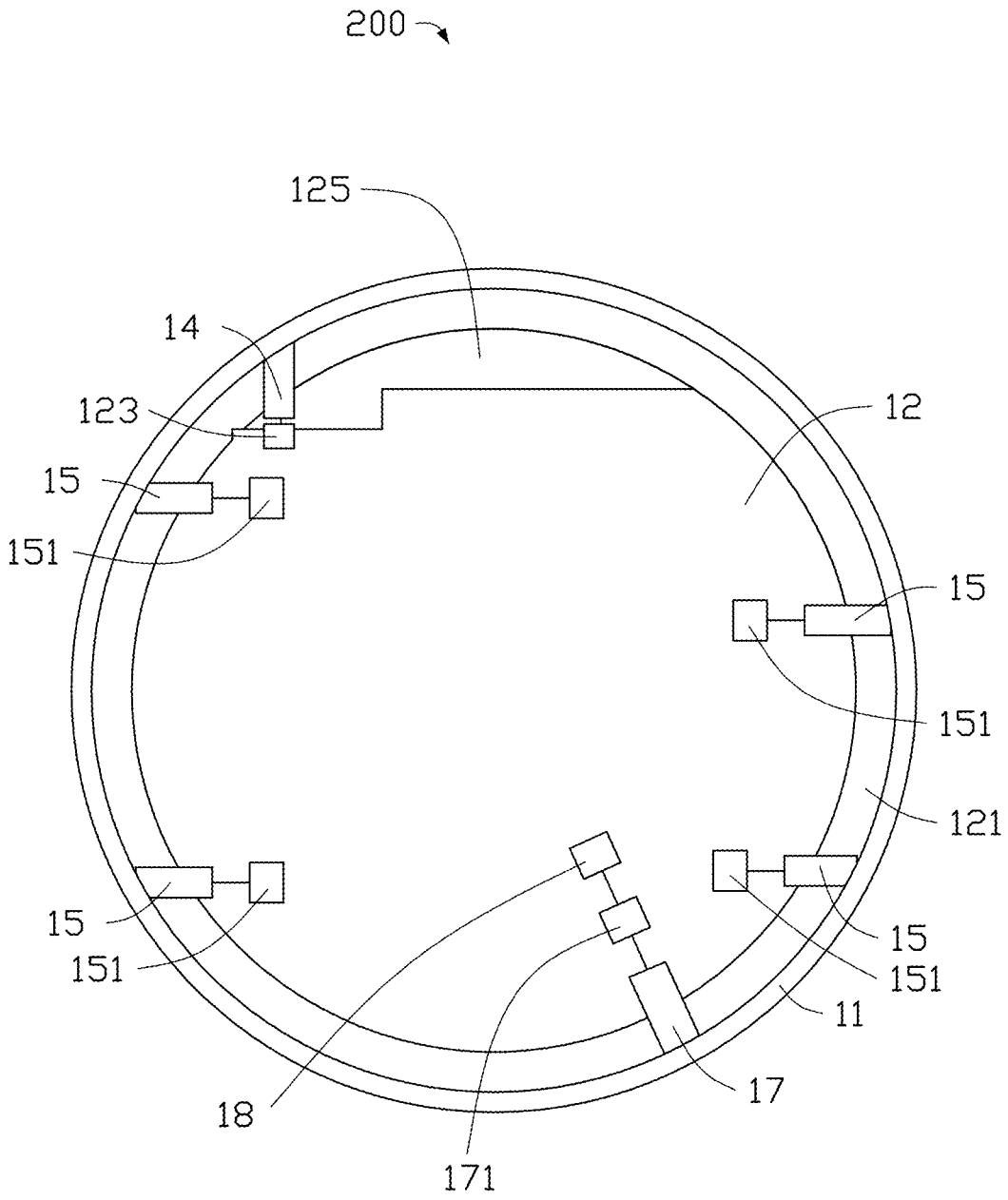
FIG. 7 is an elevational view of a second embodiment of an electronic device.

In view of FIGS. 3 to 6, the electronic device 100 has a better radiating performance as compared to a device not having the features described herein when working at the first working frequency band and the second working frequency band. FIG. 7 illustrates a second embodiment of an electronic device 200. The electronic device 200 differs from the electronic device 100 in that in FIG. 7, the radiating portion 13 is omitted. Then one end of the first feed portion 14 is electronically connected to the feed point 123. Another end of the first feed portion 14 is electrically connected to the frame 11 through a HPF (not shown). Then, the feed point 123 can directly feed the current to the frame 11 through the first feed portion 14. Additionally, due to another end of the first feed portion 14 is directly and electrically connected to the frame 11 through a HPF, which can effectively prevent the signal of the second working frequency band, for example, ECG signal or NFC signal from entering from the feed point 123.

Figure 8:
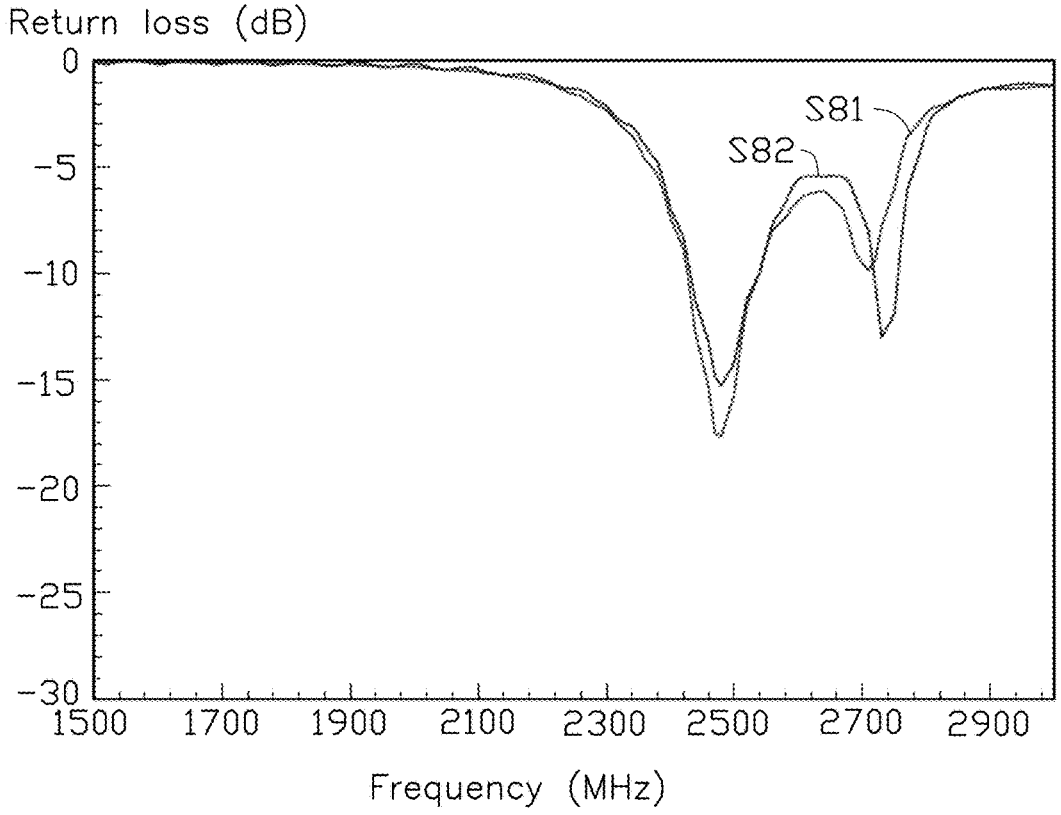
FIG. 8 is a return loss graph of the electronic device of FIG. 7.

FIG. 8 illustrates a return loss graph of the electronic device 200. Curve S81 illustrates a return loss of the electronic device 200 when each ground portion 15 is in series with a resistor having a resistance of about 0 ohm. Curve S82 illustrates a return loss of the electronic device 200 when each ground portion 15 is in series with a capacitor having a capacitance of about 20 pF.

Figure 9:
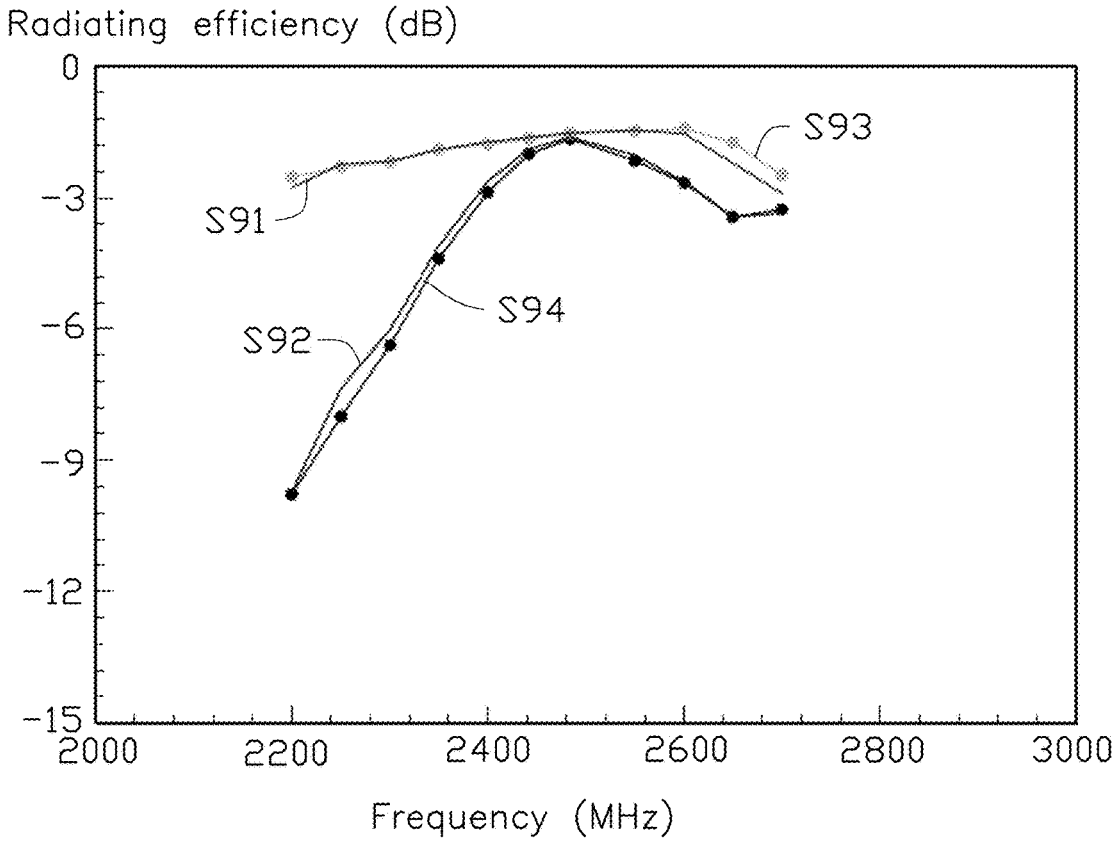
FIG. 9 is a radiating efficiency graph of the electronic device of FIG. 7.

FIG. 9 illustrates a radiating efficiency graph of the electronic device 200. Curve S91 illustrates a radiating efficiency of the electronic device 200 when each ground portion 15 is in series with a resistor having a resistance of about 0 ohm. Curve S92 illustrates a total radiating efficiency of the electronic device 200 when each ground portion 15 is in series with a resistor having a resistance of about 0 ohm. Curve S93 illustrates a radiating efficiency of the electronic device 200 when each ground portion 15 is in series with a capacitor having a capacitance of about 20 pF. Curve S94 illustrates a total radiating efficiency of the electronic device 200 when each ground portion 15 is in series with a capacitor having a capacitance of about 20 pF.

Figure 10:
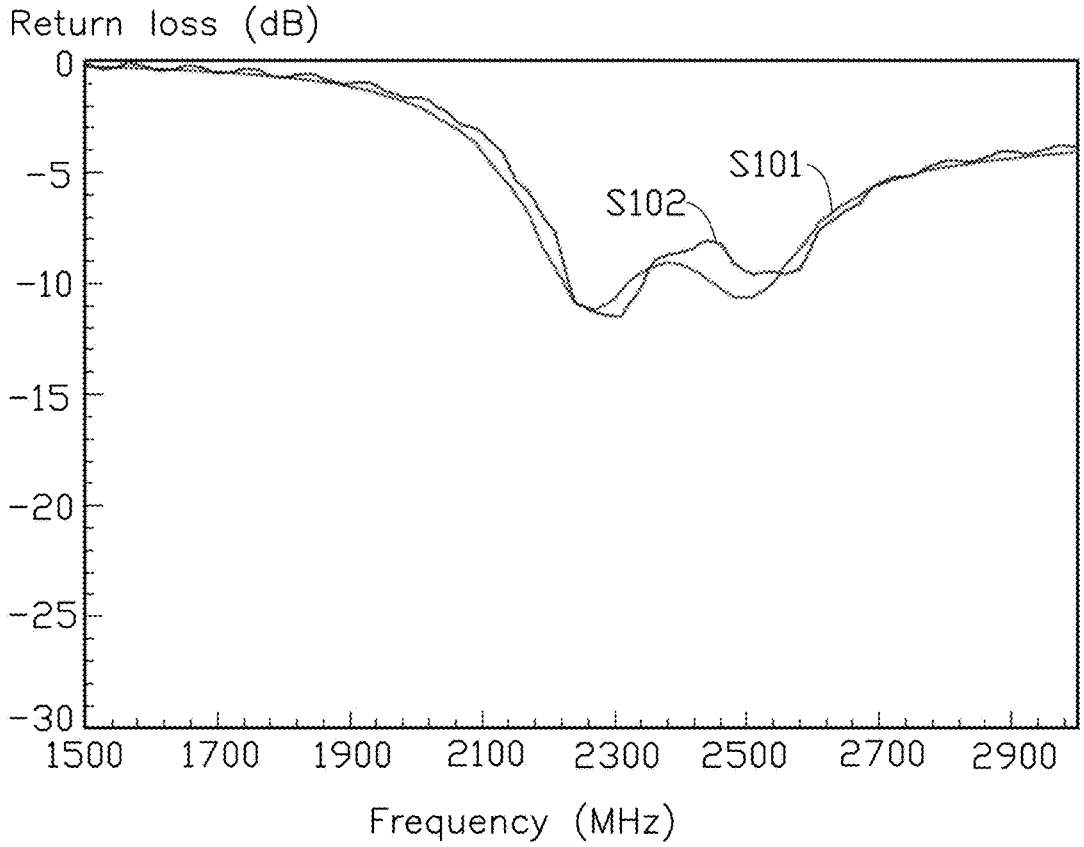
FIG. 10 is a return loss graph of the electronic device of FIG. 7 when the electronic device is attached to a wrist of a user.

FIG. 10 illustrates a return loss graph of the electronic device 200 when the electronic device 100 is attached to the wrist of the user. Curve S101 illustrates a return loss of the electronic device 200 when the electronic device 200 is attached to the wrist of the user and each ground portion 15 is in series with a resistor having a resistance of about 0 ohm. Curve S102 illustrates a return loss of the electronic device 200 when the electronic device 200 is attached to the wrist of the user and each ground portion 15 is in series with a capacitor having a capacitance of about 20 pF.

Figure 11:
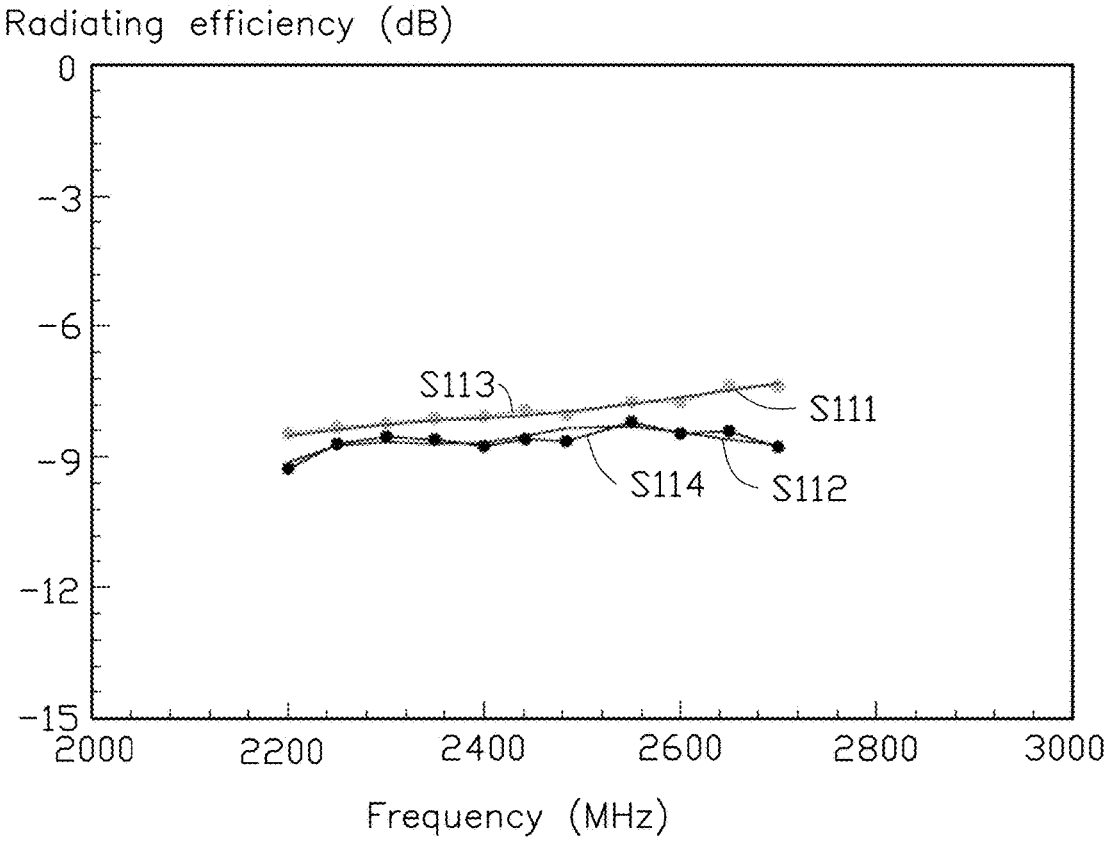
FIG. 11 is a radiating efficiency graph of the electronic device of FIG. 7 when the electronic device is attached to a wrist of a user.

FIG. 11 illustrates a radiating efficiency graph of the electronic device 200 when the electronic device 200 is attached to the wrist of the user. Curve S111 illustrates a radiating efficiency of the electronic device 200 when the electronic device 200 is attached to the wrist of the user and each ground portion 15 is in series with a resistor having a resistance of about 0 ohm. Curve S112 illustrates a total radiating efficiency of the electronic device 200 when the electronic device 200 is attached to the wrist of the user and each ground portion 15 is in series with a resistor having a resistance of about 0 ohm. Curve S113 illustrates a radiating efficiency of the electronic device 200 when the electronic device 200 is attached to the wrist of the user and each ground portion 15 is in series with a capacitor having a capacitance of about 20 pF. Curve S114 illustrates a total radiating efficiency of the electronic device 200 when the electronic device 200 is attached to the wrist of the user and each ground portion 15 is in series with a capacitor having a capacitance of about 20 pF.

In view of FIGS. 8 to 11, in the second embodiment, when the radiating portion 13 is omitted, one end of the first feed portion 14 is directly and electrically connected to the feed point 123, and another end of the first feed portion 14 is directly and electrically connected to the frame 11 through the HPF, the electronic device 200 also has a better radiating performance as compared to a device not having the features described herein.

Figure 12:
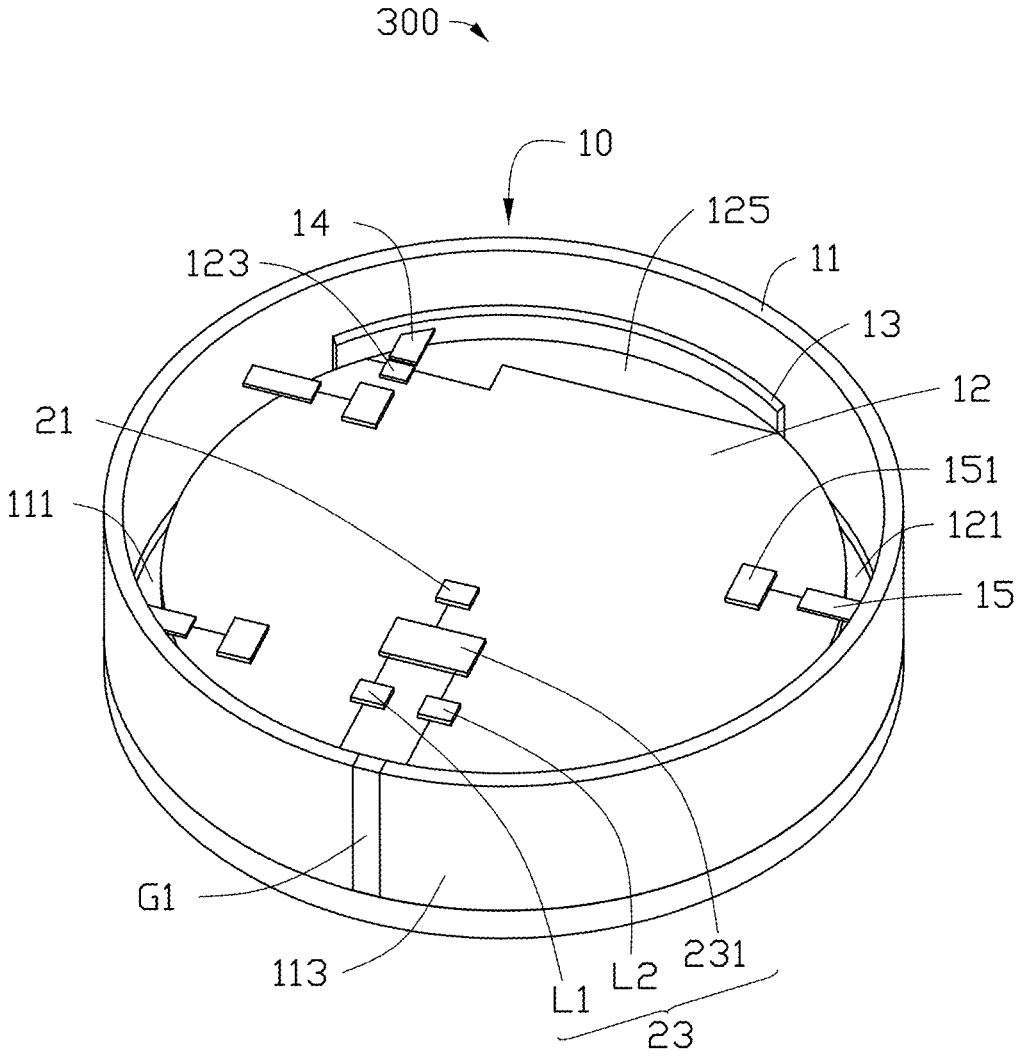
FIG. 12 is an elevational view of a third embodiment of an electronic device.
Figure 13:
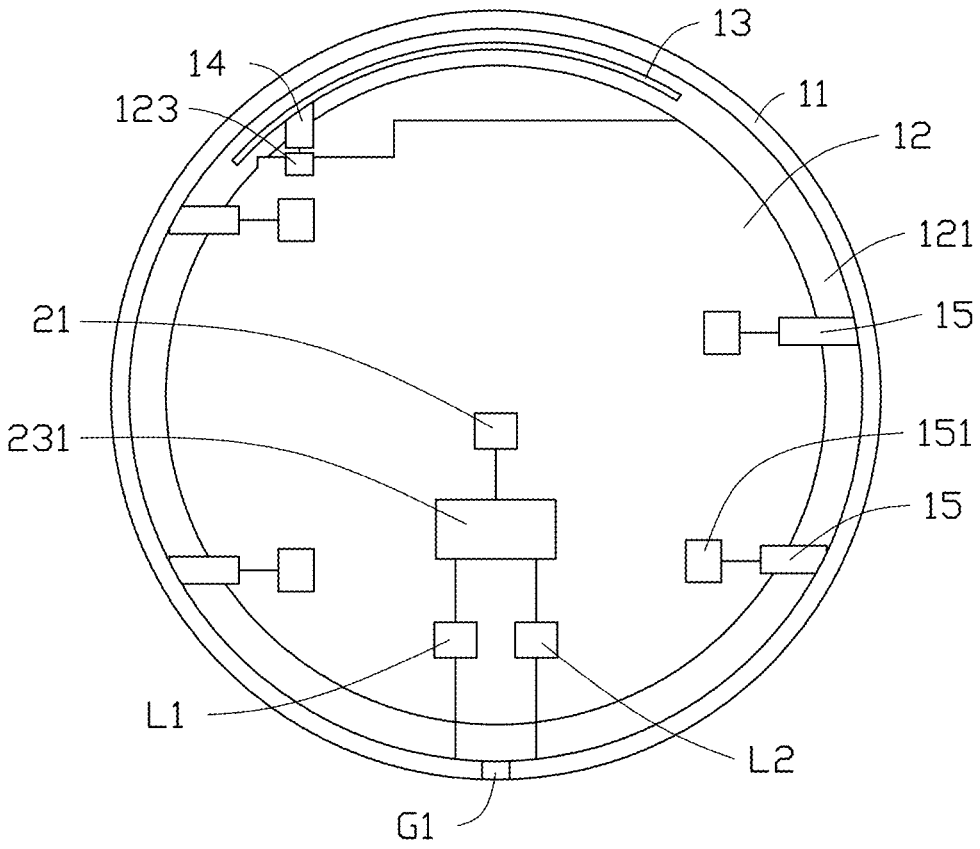
FIG. 13 is similar to FIG. 12, but shown in another angle.

FIGS. 12 and 13 illustrate a third embodiment of an electronic device 200. The electronic device 300 differs from the electronic device 100 in that the electronic device 300 has an ECG function. In detail, the frame 11 has two ends spaced from each other to define a slit G1. In the exemplary embodiment, the slit G1 has a width of about 1.5 mm. The electronic device 300 further includes a NFC unit 21 and a matching circuit 23. The NFC unit 21 and the RF transceiving unit share the frame 11, then the electronic device 300 can work at the first and second working frequency bands.

The matching circuit 23 includes a matching-amplifying unit 231 and at least one inductor. The matching-amplifying unit 231 includes at least one impedance matching circuit and a signal amplifying circuit. In the exemplary embodiment, the matching circuit 23 includes two inductors, that is, a first inductor L1 and a second inductor L2. One end of the first inductor L1 is electrically connected to one end of the frame 11 adjacent to the slit G1, that is, electrically connected to the frame 11. Another end of the first inductor L1 is electrically connected to the NFC unit 21 through the matching-amplifying unit 231. One end of the second inductor L2 is electrically connected to another end of the frame 11 adjacent to the slit G1, that is, electrically connected to the frame 11. Another end of the second inductor L2 is also electrically connected to the NFC unit 21 through the matching-amplifying unit 231. Then, the frame 11, the NFC unit 21, and the matching circuit 23 cooperatively form a loop circuit.

Figure 14:
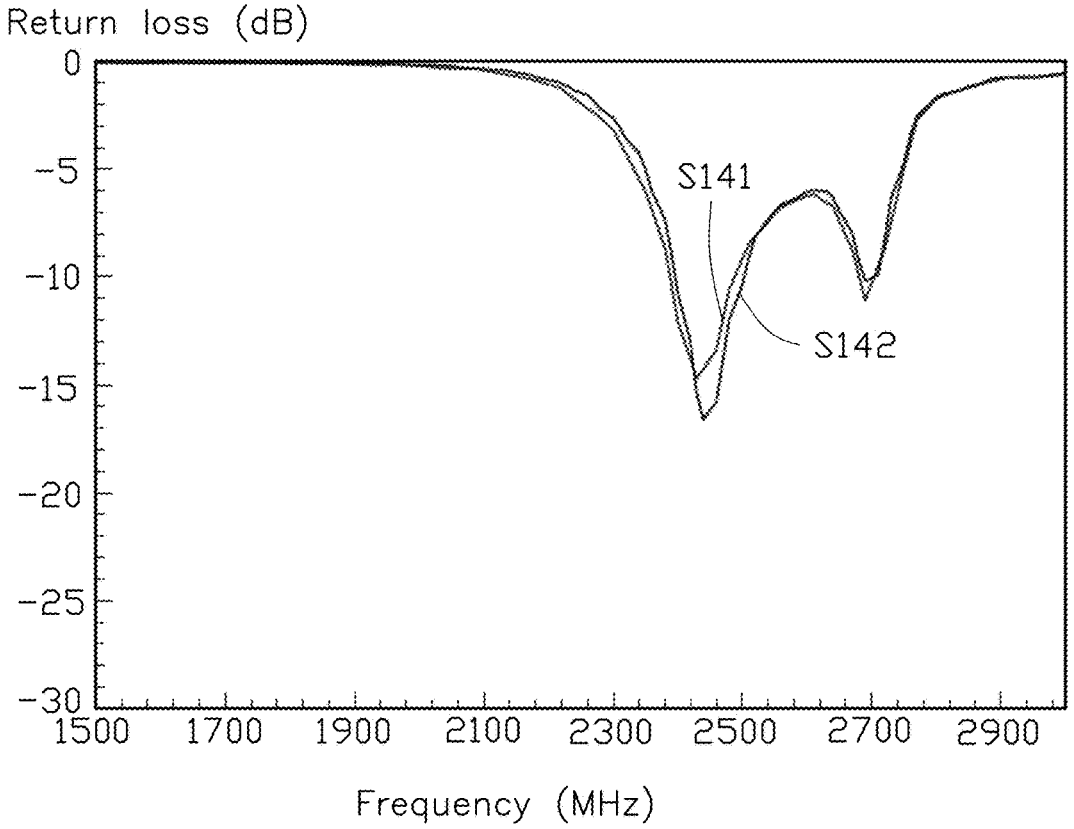
FIG. 14 is a return loss graph of the electronic device of FIG. 12.

FIG. 14 illustrates a return loss graph of the electronic device 300. Curve S141 illustrates a return loss of the electronic device 300 when each ground portion 15 is in series with a resistor having a resistance of about 0 ohm. Curve S142 illustrates a return loss of the electronic device 300 when each ground portion 15 is in series with a capacitor having a capacitance of about 20 pF.

Figure 15:
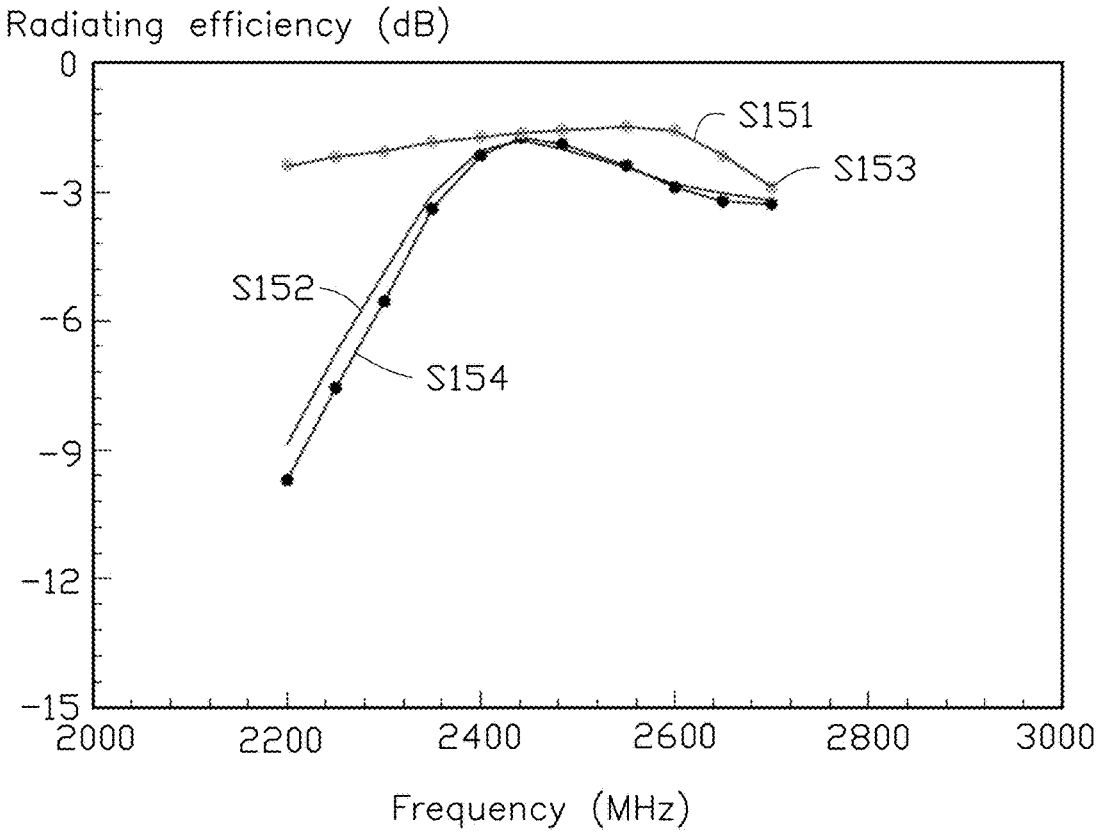
FIG. 15 is a radiating efficiency graph of the electronic device of FIG. 12.

FIG. 15 illustrates a radiating efficiency graph of the electronic device 300. Curve S151 illustrates a radiating efficiency of the electronic device 300 when each ground portion 15 is in series with a resistor having a resistance of about 0 ohm. Curve S152 illustrates a total radiating efficiency of the electronic device 300 when each ground portion 15 is in series with a resistor having a resistance of about 0 ohm. Curve S153 illustrates a radiating efficiency of the electronic device 300 when each ground portion 15 is in series with a capacitor having a capacitance of about 20 pF. Curve S154 illustrates a total radiating efficiency of the electronic device 300 when each ground portion 15 is in series with a capacitor having a capacitance of about 20 pF.

Figure 16:
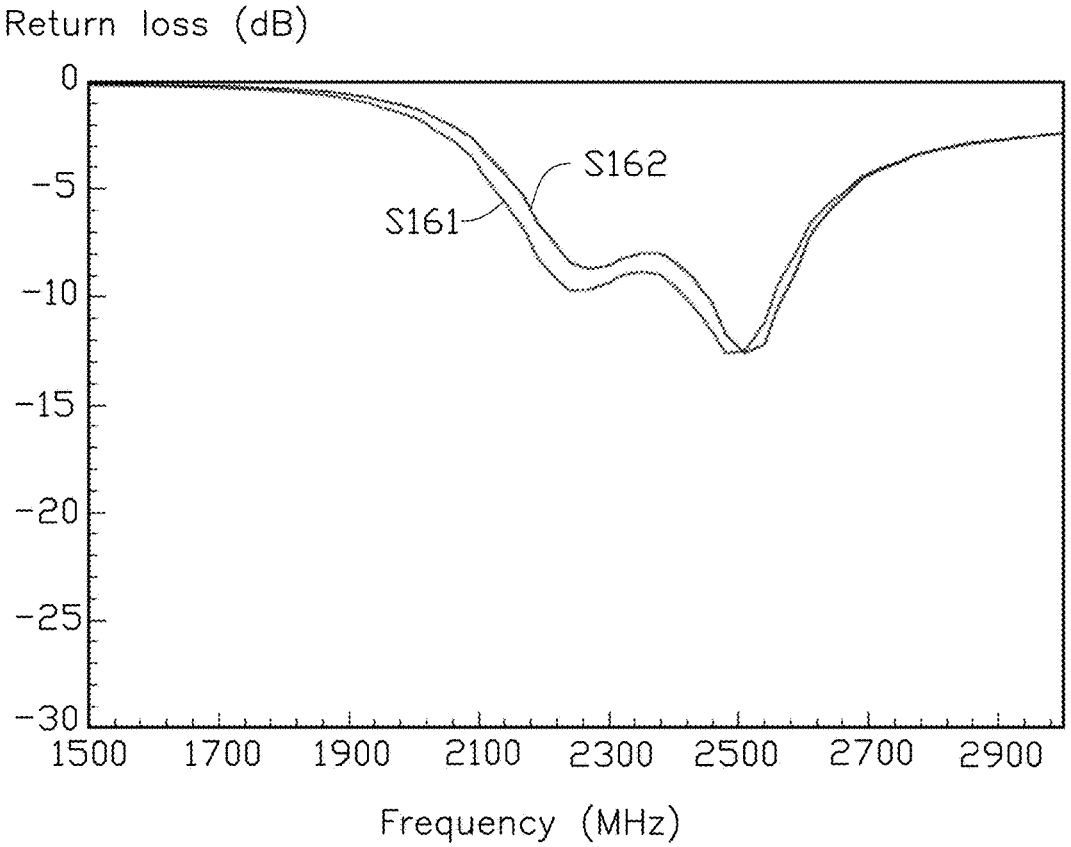
FIG. 16 is a return loss graph of the electronic device of FIG. 12 when the electronic device is attached to a wrist of a user.

FIG. 16 illustrates a return loss graph of the electronic device 300 when the electronic device 300 is attached to the wrist of the user. Curve S161 illustrates a return loss of the electronic device 300 when the electronic device 300 is attached to the wrist of the user and each ground portion 15 is in series with a resistor having a resistance of about 0 ohm. Curve S162 illustrates a return loss of the electronic device 300 when the electronic device 300 is attached to the wrist of the user and each ground portion 15 is in series with a capacitor having a capacitance of about 20 pF.

Figure 17:
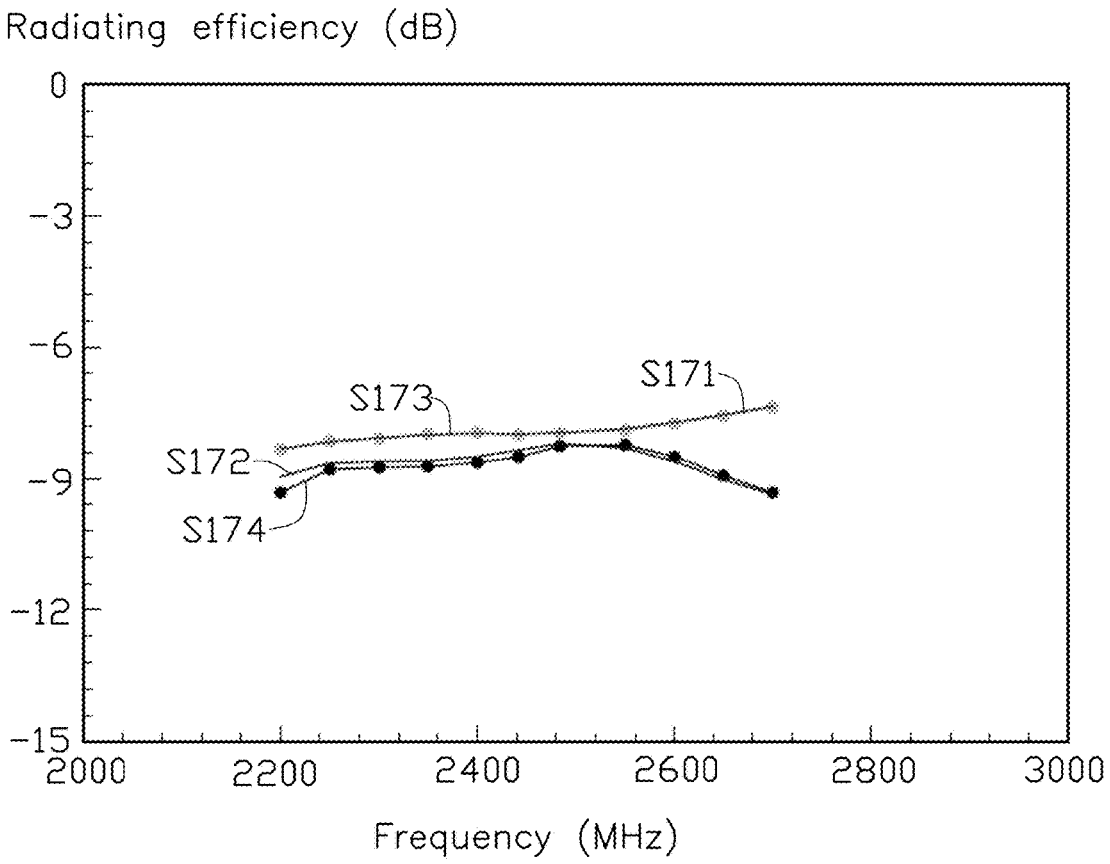
FIG. 17 is a radiating efficiency graph of the electronic device of FIG. 12 when the electronic device is attached to a wrist of a user.

FIG. 17 illustrates a radiating efficiency graph of the electronic device 300 when the electronic device 300 is attached to the wrist of the user. Curve S171 illustrates a radiating efficiency of the electronic device 300 when the electronic device 300 is attached to the wrist of the user and each ground portion 15 is in series with a resistor having a resistance of about 0 ohm. Curve S172 illustrates a total radiating efficiency of the electronic device 300 when the electronic device 300 is attached to the wrist of the user and each ground portion 15 is in series with a resistor having a resistance of about 0 ohm. Curve S173 illustrates a radiating efficiency of the electronic device 300 when the electronic device 300 is attached to the wrist of the user and each ground portion 15 is in series with a capacitor having a capacitance of about 20 pF. Curve S174 illustrates a total radiating efficiency of the electronic device 300 when the electronic device 300 is attached to the wrist of the user and each ground portion 15 is in series with a capacitor having a capacitance of about 20 pF.

In view of FIGS. 14 to 17, in the third embodiment, the electronic device 300 also has a better radiating performance as compared to a device not having the features described herein when working at the first working frequency band and the second working frequency band.

Figure 18:
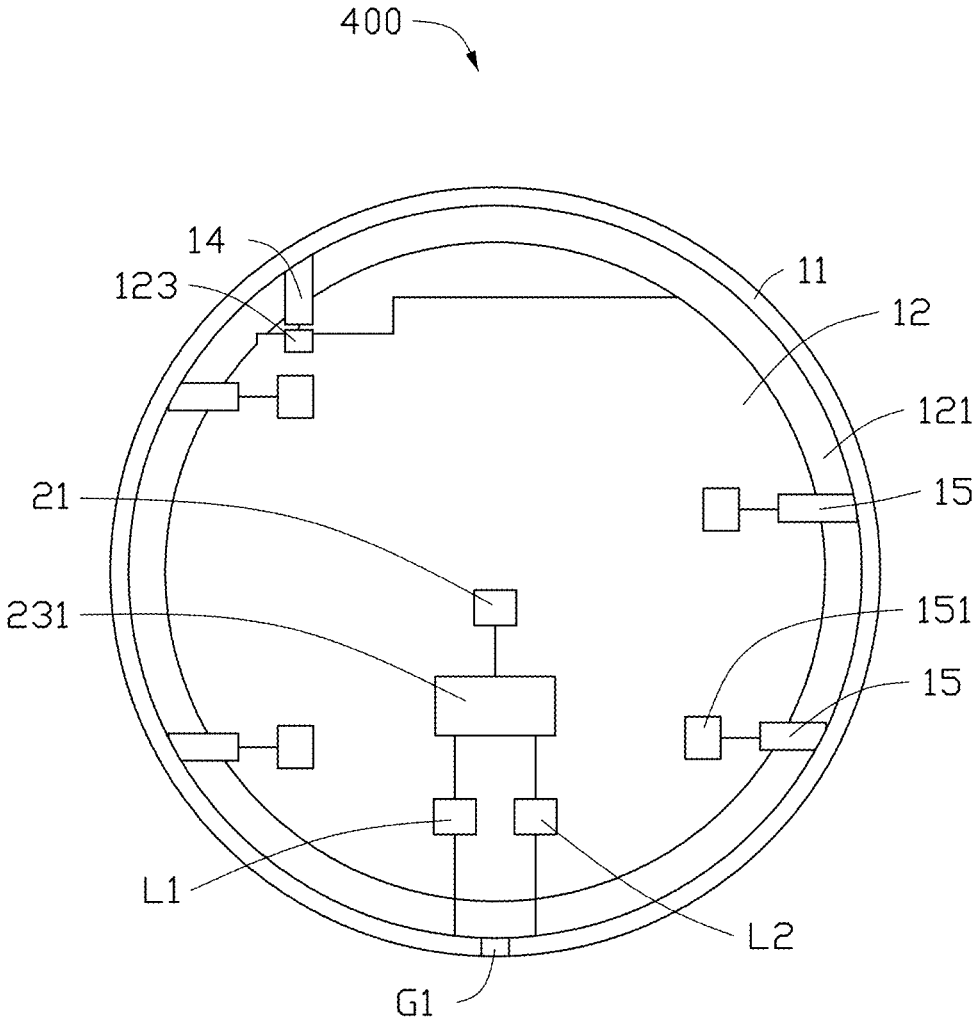
FIG. 18 is an elevational view of a fourth embodiment of an electronic device.

FIG. 18 illustrates a fourth embodiment of an electronic device 400. The electronic device 400 differs from the electronic device 300 in that the radiating portion 13 is omitted. Then, one end of the first feed portion 14 is electronically connected to the feed point 123. Another end of the first feed portion 14 is directly and electrically connected to the frame 11 through a HPF (not shown). Then, the feed point 123 can directly feed the current to the frame 11 through the first feed portion 14. Additionally, due to the another end of the first feed portion 14 is directly and electrically connected to the frame 11 through a HPF, which can effectively prevent the signal of the second working frequency band, for example, ECG signal or NFC signal from entering from the feed point 123.

Figure 19:
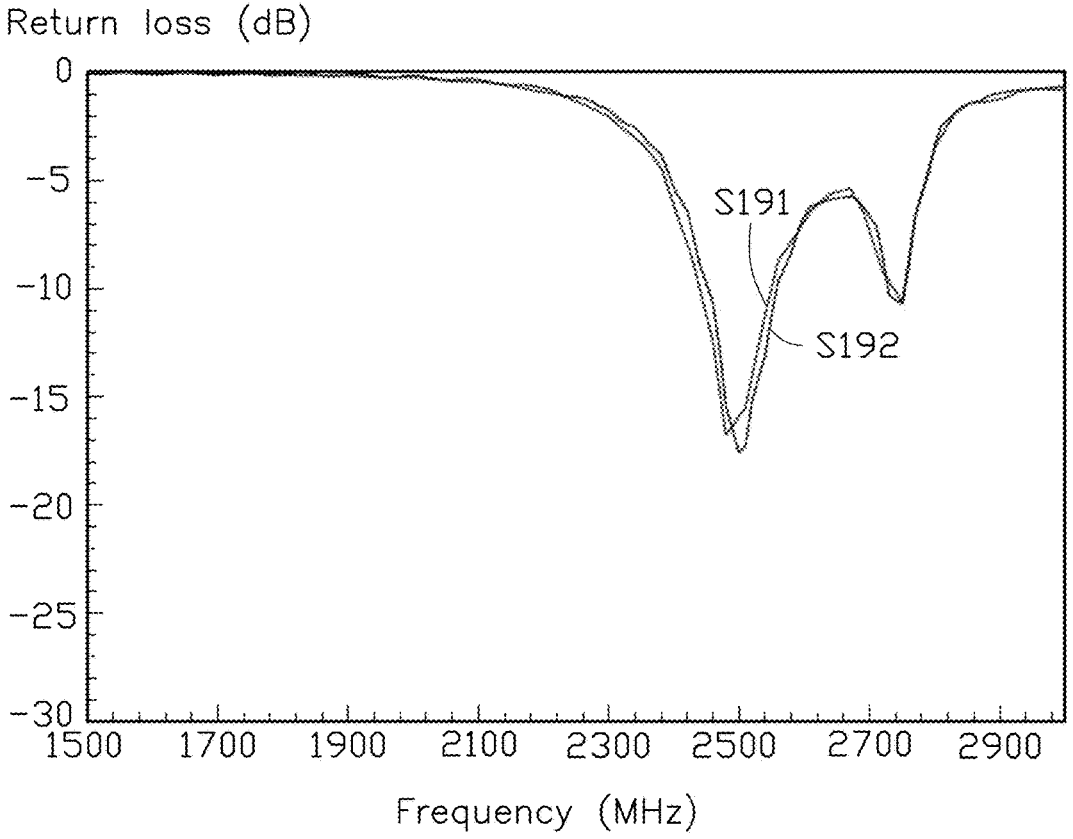
FIG. 19 is a return loss graph of the electronic device of FIG. 18.

FIG. 19 illustrates a return loss graph of the electronic device 400. Curve S191 illustrates a return loss of the electronic device 400 when each ground portion 15 is in series with a resistor having a resistance of about 0 ohm. Curve S192 illustrates a return loss of the electronic device 400 when each ground portion 15 is in series with a capacitor having a capacitance of about 20 pF.

Figure 20:
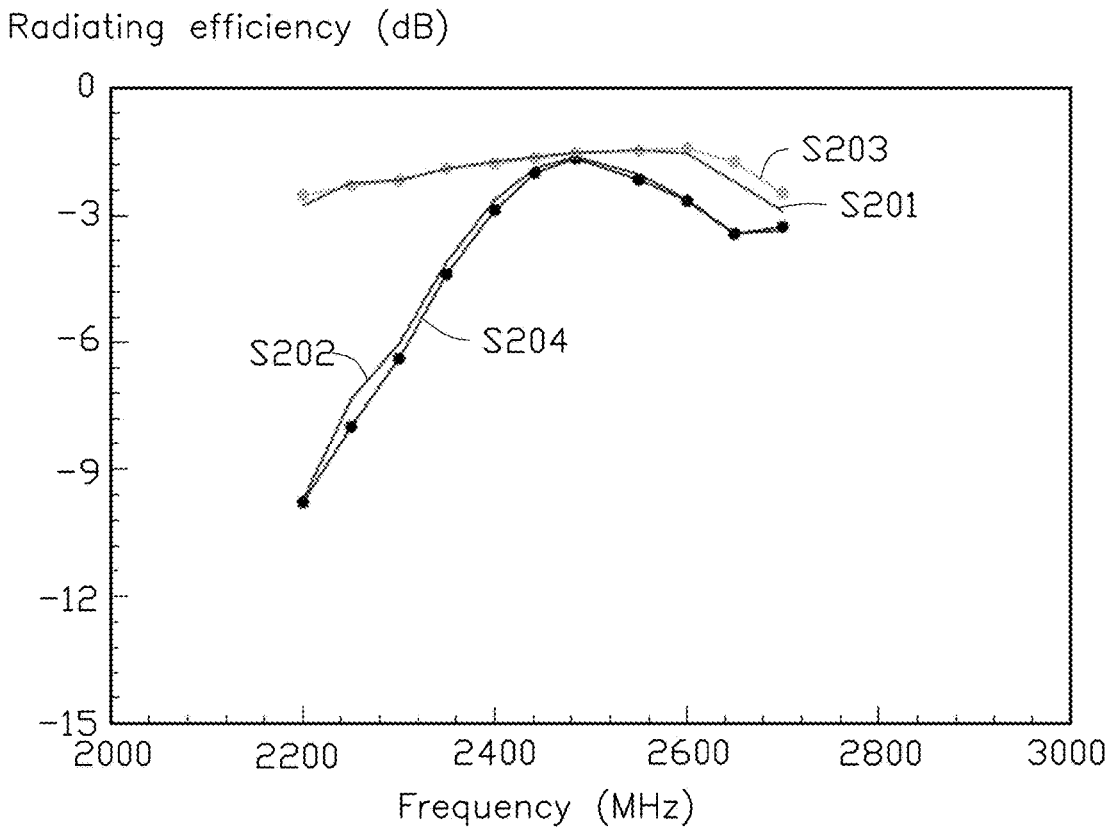
FIG. 20 is a radiating efficiency graph of the electronic device of FIG. 18.

FIG. 20 illustrates a radiating efficiency graph of the electronic device 400. Curve S201 illustrates a radiating efficiency of the electronic device 400 when each ground portion 15 is in series with a resistor having a resistance of about 0 ohm. Curve S202 illustrates a total radiating efficiency of the electronic device 400 when each ground portion 15 is in series with a resistor having a resistance of about 0 ohm. Curve S203 illustrates a radiating efficiency of the electronic device 400 when each ground portion 15 is in series with a capacitor having a capacitance of about 20 pF. Curve S204 illustrates a total radiating efficiency of the electronic device 400 when each ground portion 15 is in series with a capacitor having a capacitance of about 20 pF.

Figure 21:
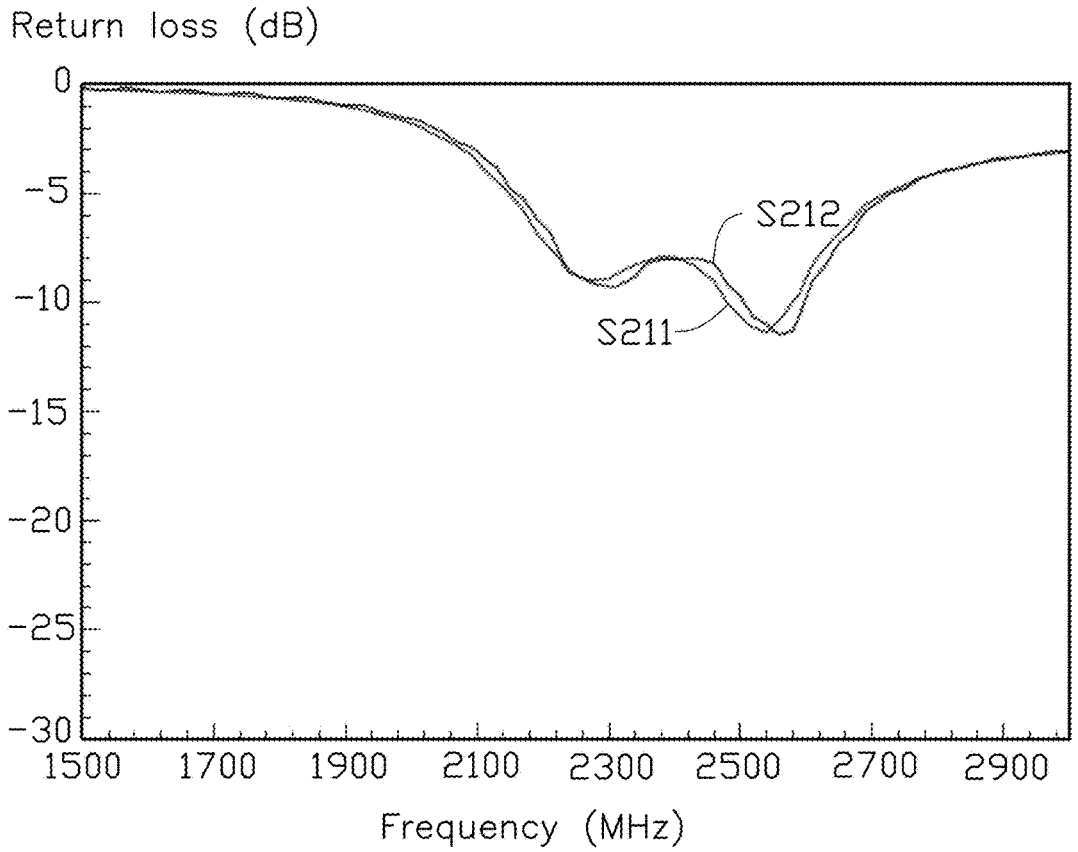
FIG. 21 is a return loss graph of the electronic device of FIG. 18 when the electronic device is attached to a wrist of a user.

FIG. 21 illustrates a return loss graph of the electronic device 400 when the electronic device 400 is attached to the wrist of the user. Curve S211 illustrates a return loss of the electronic device 400 when the electronic device 400 is attached to the wrist of the user and each ground portion 15 is in series with a resistor having a resistance of about 0 ohm. Curve S212 illustrates a return loss of the electronic device 400 when the electronic device 400 is attached to the wrist of the user and each ground portion 15 is in series with a capacitor having a capacitance of about 20 pF.

Figure 22:
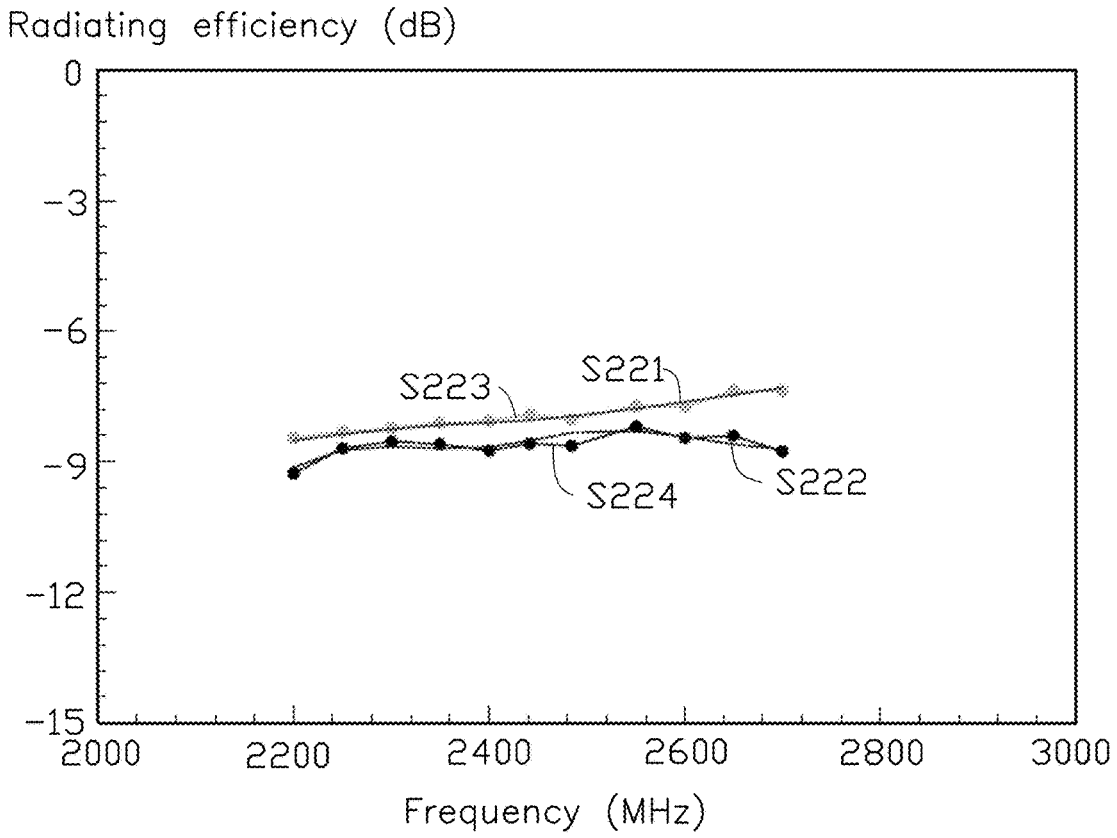
FIG. 22 is a radiating efficiency graph of the electronic device of FIG. 18 when the electronic device is attached to a wrist of a user.

FIG. 22 illustrates a radiating efficiency graph of the electronic device 400 when the electronic device 400 is attached to the wrist of the user. Curve S221 illustrates a radiating efficiency of the electronic device 400 when the electronic device 400 is attached to the wrist of the user and each ground portion 15 is in series with a resistor having a resistance of about 0 ohm. Curve S222 illustrates a total radiating efficiency of the electronic device 400 when the electronic device 400 is attached to the wrist of the user and each ground portion 15 is in series with a resistor having a resistance of about 0 ohm. Curve S223 illustrates a radiating efficiency of the electronic device 400 when the electronic device 400 is attached to the wrist of the user and each ground portion 15 is in series with a capacitor having a capacitance of about 20 pF. Curve S224 illustrates a total radiating efficiency of the electronic device 400 when the electronic device 400 is attached to the wrist of the user and each ground portion 15 is in series with a capacitor having a capacitance of about 20 pF.

In view of FIGS. 19 to 22, in the fourth embodiment when the radiating portion 13 is omitted, one end of the first feed portion 14 is directly and electrically connected to the feed point 123, and another end of the first feed portion 14 is directly and electrically connected to the frame through the HPF, the electronic device 400 also has a better radiating performance as compared to a device not having the features described herein.

Figure 23:
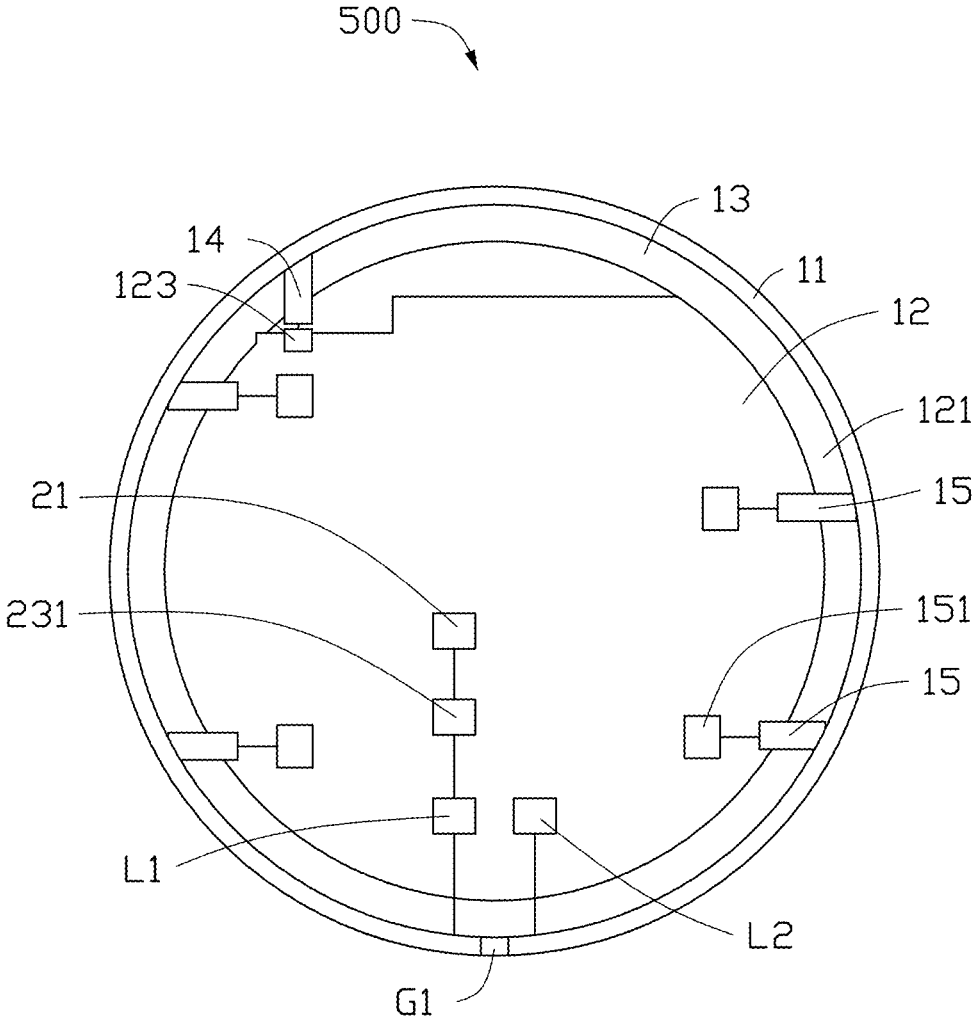
FIG. 23 is an elevational view of a fifth embodiment of an electronic device.

FIG. 23 illustrates a fifth embodiment of an electronic device 500. The electronic device 500 differs from the electronic device 400 in that the NFC antenna only has one feeder. That is, one end of the first inductor L1 is electronically connected to one end of the frame 11 adjacent to the slit G1. Another end of the first inductor L1 is electrically connected to the NFC unit 21 through the matching-amplifying unit 231. One end of the second inductor L2 is electrically connected to another end of the frame 11 adjacent to the slit G1. Another end of the second inductor L2 is directly grounded.

Figure 24:
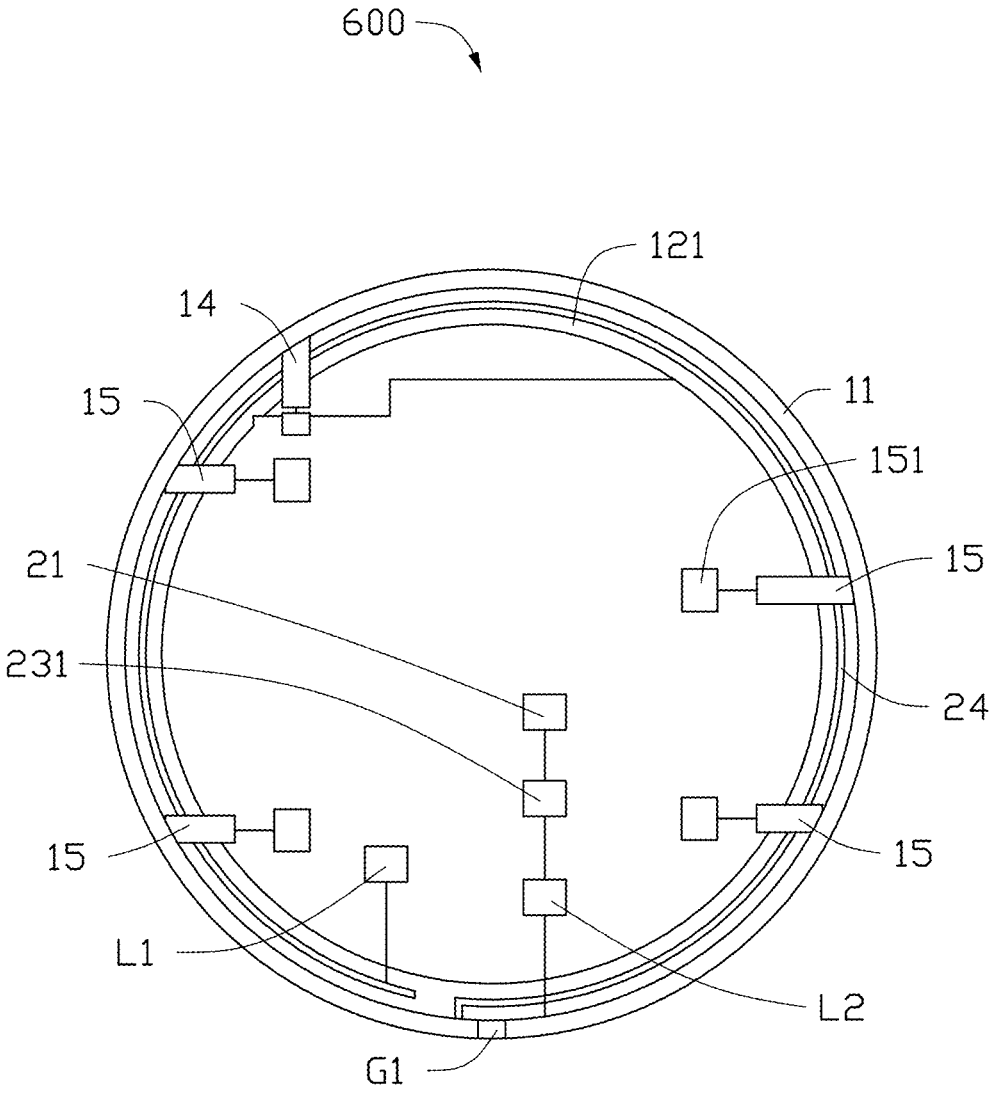
FIG. 24 is an elevational view of a sixth embodiment of an electronic device.

FIG. 24 illustrates a sixth embodiment of an electronic device 600. The electronic device 600 differs from the electronic device 400 in that the electronic device 600 further includes a coupling portion 24. The coupling portion 24 is made of conductive material and is positioned in the gap 121. One end of the coupling portion 24 is electrically connected to one end of the slit G1. Another end of the coupling portion 24 is grounded through the first inductor L1. One end of the second inductor L2 is electrically connected to another end of the slit G1. Another end of the second inductor L2 is electrically connected to the NFC unit 21 through the matching-amplifying unit 231.

Figure 25:
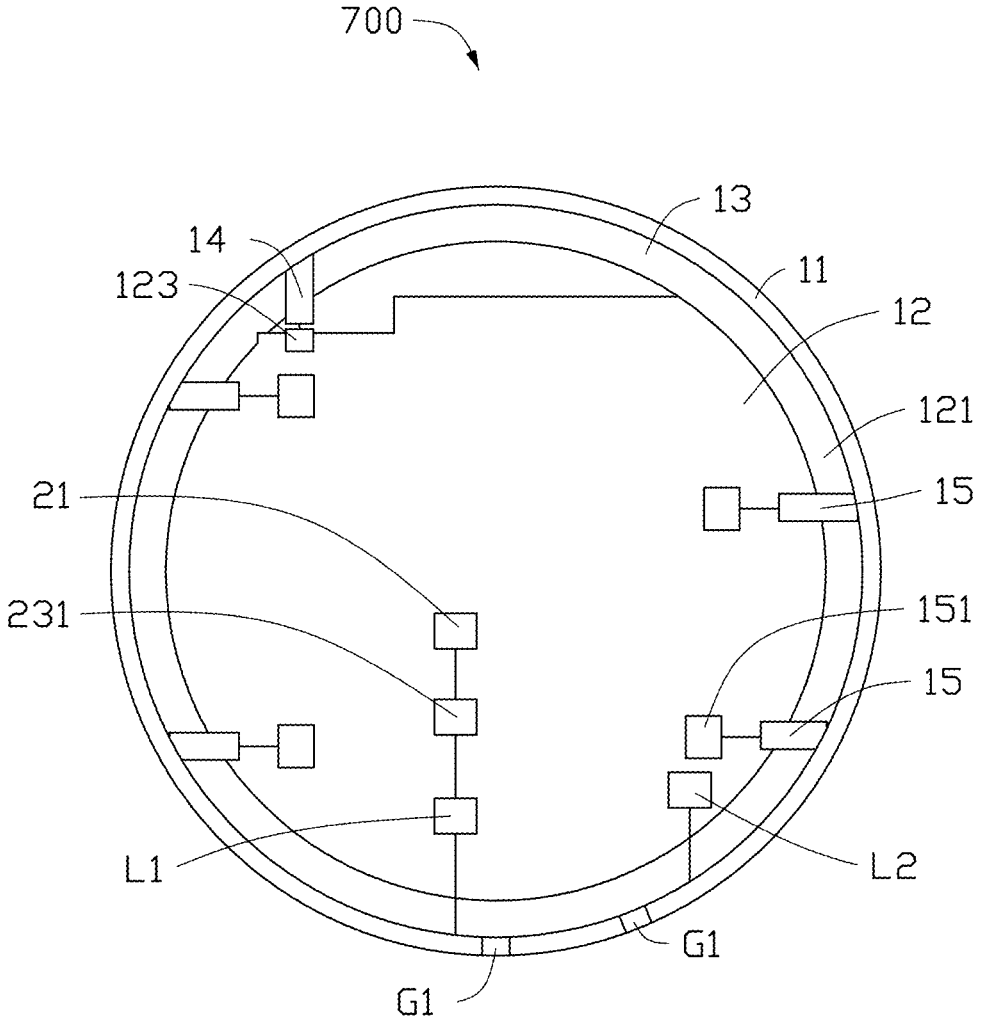
FIG. 25 is an elevational view of a seventh embodiment of an electronic device.

FIG. 25 illustrates a seventh embodiment of an electronic device 700. The electronic device 700 differs from the electronic device 500 in that the frame 11 has at least two ends spaced from each other to define a plurality of slits G1. In the exemplary embodiment, the frame 11 has four ends spaced from each other to define two slits G1. One end of the first inductor L1 is electrically connected to one end of the four ends. Another end of the first inductor L1 is electrically connected to the NFC unit 21 through the matching-amplifying unit 231. One end of the second inductor L2 is electrically connected to one end of another end of the four. Another end of the second inductor L2 is grounded.

The embodiments shown and described above are only examples. Many details are often found in the art such as the other features of the electronic device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An electronic device comprising:

a frame formed of conductive material;

a baseboard received in the frame and spaced from the frame, the baseboard and the frame cooperatively forming a gap, and the baseboard comprising a feed point electrically connected to the frame;

at least one ground portion, one end of each ground portion electrically connected to the frame and another end of each ground portion grounded through a high pass filter (HPF);

a first feed portion, one end of the first feed portion electrically connected to a radiating portion or electrically connected to the frame through an HPF, another end of the first feed portion electrically connected to the feed point;

a housing formed of conductive material;

a second feed portion formed of conductive material; and a physiology sensing unit;

wherein one end of the second feed portion is electrically connected to the frame, another end of the second feed portion is electrically connected to the physiology sensing unit through a low pass filter (LPF), and the housing is electrically connected to the physiology sensing unit.

2. The electronic device of claim 1, wherein the radiating portion is positioned in the gap and is spaced from the baseboard and the frame; and wherein one end of the first feed portion is electrically connected to the radiating portion, and the radiating portion is coupled to the frame.

3. The electronic device of claim 1, wherein the housing is assembled to the frame and is configured to receive the baseboard with the frame.

4. The electronic device of claim 1, further comprising a near-field communication (NFC) unit and a matching circuit, wherein the frame has two ends spaced from each other to define a slit, the matching circuit comprises a matching-amplifying unit, a first inductor, and a second inductor; and wherein one end of the first inductor is electrically connected to an end of the frame, one end of the second inductor is electrically connected to another end of the frame, another end of the first inductor and another end of the second inductor are both electrically connected to the NFC unit through the matching-amplifying unit.

5. The electronic device of claim 1, further comprising a NFC unit and a matching circuit, wherein the frame has at least two ends spaced from each other to define at least one slit, the matching circuit comprises a matching-amplifying unit, a first inductor, and a second inductor; and wherein one end of the first inductor is electrically connected to one end of the at least two ends to electrically connect to the frame, another end of the first inductor is electrically connected to the NFC unit through the matching-amplifying unit, one end of the second inductor is electrically connected to another end of the at least two ends, and another end of the second inductor is grounded.

6. The electronic device of claim 1, further comprising a NFC unit and a matching circuit, wherein the frame has at least two ends spaced from each other to define at least one slit, the matching circuit comprises a matching-amplifying unit, a first inductor, a second inductor, and a coupling portion; and wherein one end of the first inductor is electrically connected to one end of the at least two ends to electrically connect the frame, another end of the first inductor is electrically connected to the NFC unit through the matching-amplifying unit, one end of the coupling portion is electrically connected to another end of the at least two ends, another end of the coupling portion is electrically connected to one end of the second inductor, and another end of the second inductor is grounded.

7. An electronic device comprising:

a frame formed of conductive material;

a housing formed of conductive material, the housing assembled to the frame and cooperatively forming a receiving space with the frame;

a baseboard received in the receiving space and spaced from the frame, the baseboard and the frame cooperatively forming a gap;

at least one ground portion, one end of each ground portion electrically connected to the frame and another end of each ground portion grounded through a high pass filter (HPF);

a first feed portion, one end of the first feed portion electrically connected to a radiating portion or electrically connected to the frame through an HPF, another end of the first feed portion electrically connected to a feed point of the baseboard;

a second feed portion formed of conductive material; and a physiology sensing unit;

wherein one end of the second feed portion is electrically connected to the frame, another end of the second feed portion is electrically connected to the physiology sensing unit through a low pass filter (LPF), and the housing is electrically connected to the physiology sensing unit; and wherein when the electronic device operates at a first working frequency band, the HPF is configured to insulate a signal from a second working frequency band, and when the electronic device operates at the second working frequency band, the HPF is configured to insulate a signal from the first working frequency band.

8. The electronic device of claim 7, wherein the radiating portion is positioned in the gap and is spaced from the baseboard and the frame; and wherein one end of the first feed portion is electrically connected to the radiating portion and the radiating portion is coupled to the frame.

9. The electronic device of claim 7, further comprising a NFC unit and a matching circuit, wherein the frame has two ends spaced from each other to define a slit, the matching circuit comprises a matching-amplifying unit, a first inductor, and a second inductor; and wherein one end of the first inductor is electrically connected to an end of the frame, one end of the second inductor is electrically connected to another end of the frame, another end of the first inductor and another end of the second inductor are both electrically connected to the NFC unit through the matching-amplifying unit.

10. The electronic device of claim 7, further comprising a NFC unit and a matching circuit, wherein the frame has at least two ends spaced from each other to define at least one slit, the matching circuit comprises a matching-amplifying unit, a first inductor, and a second inductor; and wherein one end of the first inductor is electrically connected to one end of the at least two ends to electrically connect to the frame, another end of the first inductor is electrically connected to the NFC unit through the matching-amplifying unit, one end of the second inductor is electrically connected to another end of the at least two ends, and another end of the second inductor is grounded.

11. The electronic device of claim 7, further comprising a NFC unit and a matching circuit, wherein the frame has at least two ends spaced from each other to define at least one slit, the matching circuit comprises a matching-amplifying unit, a first inductor, a second inductor, and a coupling portion; and wherein one end of the first inductor is electrically connected to one end of the at least two ends to electrically connect the frame, another end of the first inductor is electrically connected to the NFC unit through the matching-amplifying unit, one end of the coupling portion is electrically connected to another end of the at least two ends, another end of the coupling portion is electrically connected to one end of the second inductor, and another end of the second inductor is grounded.

* * * * *